United States Patent [19]

Maclay et al.

[11] Patent Number: 4,588,901

[45] Date of Patent: May 13, 1986

[54] TIMER CONTROL FOR TELEVISION

[75] Inventors: William R. Maclay, Los Gatos; William A. Hewett, San Diego, both of Calif.

[73] Assignee: Pentalux Corporation, Mountain View, Calif.

[21] Appl. No.: 701,920

[22] Filed: Feb. 14, 1985

[51] Int. Cl.[4] ..... H01H 7/00; H01H 3/34; H01H 33/59; H01H 47/00

[52] U.S. Cl. ..... 307/141; 307/141.4; 307/141.8; 307/125

[58] Field of Search ..... 307/141.4, 141.8, 141, 307/125, 130, 131

[56] References Cited

U.S. PATENT DOCUMENTS

| | | | |
|---|---|---|---|
| 3,581,029 | 5/1971 | Noiles | 307/141 |
| 3,608,301 | 9/1971 | Loewengart . | |
| 3,854,281 | 12/1974 | Reichert . | |
| 3,879,332 | 4/1975 | Leone . | |
| 3,882,670 | 5/1975 | Woolley . | |
| 3,948,039 | 4/1976 | Leveraus . | |
| 4,035,661 | 7/1977 | Carlson . | |
| 4,246,495 | 1/1981 | Pressman . | |
| 4,280,063 | 7/1981 | Yokomori et al. . | |
| 4,344,000 | 8/1982 | Schornack et al. . | |
| 4,459,524 | 7/1984 | Oota et al. | 307/141.4 X |

OTHER PUBLICATIONS

Flynn, Build the Time on Reorder, Popular Electronics, Feb. 1982.

*Primary Examiner*—Wiliam M. Shoop, Jr.
*Assistant Examiner*—Alfred F. Hoyte
*Attorney, Agent, or Firm*—Gerald L. Moore

[57] ABSTRACT

A device for regulating the maximum time a television or the like can be operated, comprising a first counter (19) that can be manually set by use of a key (24A) to set a switch (24) with a predetermined time period. A second counter (20) deducts the actual operating time of the television from the first counter. The device interrupts the power circuit to the television when the predetermined time period expires. The switch can be set to allow operation of the television without deducting time from the first counter.

9 Claims, 5 Drawing Figures

TIMER CONTROL FOR TELEVISION

FIELD OF THE INVENTION

This invention relates to a timer for controlling the overall time duration an appliance, such as a television, and into which can be entered a preset time period from which the actual time the television is operated is deducted. When the preset time period is consumed the television is then turned off automatically to prevent further watching.

BACKGROUND OF THE INVENTION

While the home television has been a powerful instrument in shaping the social and business climates of the world, it still has presented its own unique problems, primarily due to overindulgence. In particular, the lure of television has presented problems with school children. It has been shown through testing that there is a strong inverse relationship between the time children spend watching television and school grades.

Parental control obviously has been attempted in regulating the amount of time children view television. However, with the higher proportion of working mothers, supervision of the children in the home has diminished. There has existed for a long time a need for an effective control to regulate the operation of the television. It is the purpose of this invention to provide such a control which allows regulation of the overall time spent in watching television.

SUMMARY OF THE INVENTION

A device for measuring and regulating the time an electrical appliance, such as a television, is used. The device includes a first counter which can be manually set with a preset time period and a second counter which, when energized, will automatically deduct time from the first counter responsive to the operation of the television. A control operable by a key disables the second counter from deducting time from the first counter when desired. When the first counter reaches a zero time setting, the power circuit to the appliance is interrupted thereby preventing further operation.

DESCRIPTION OF THE INVENTION

Figure 1:
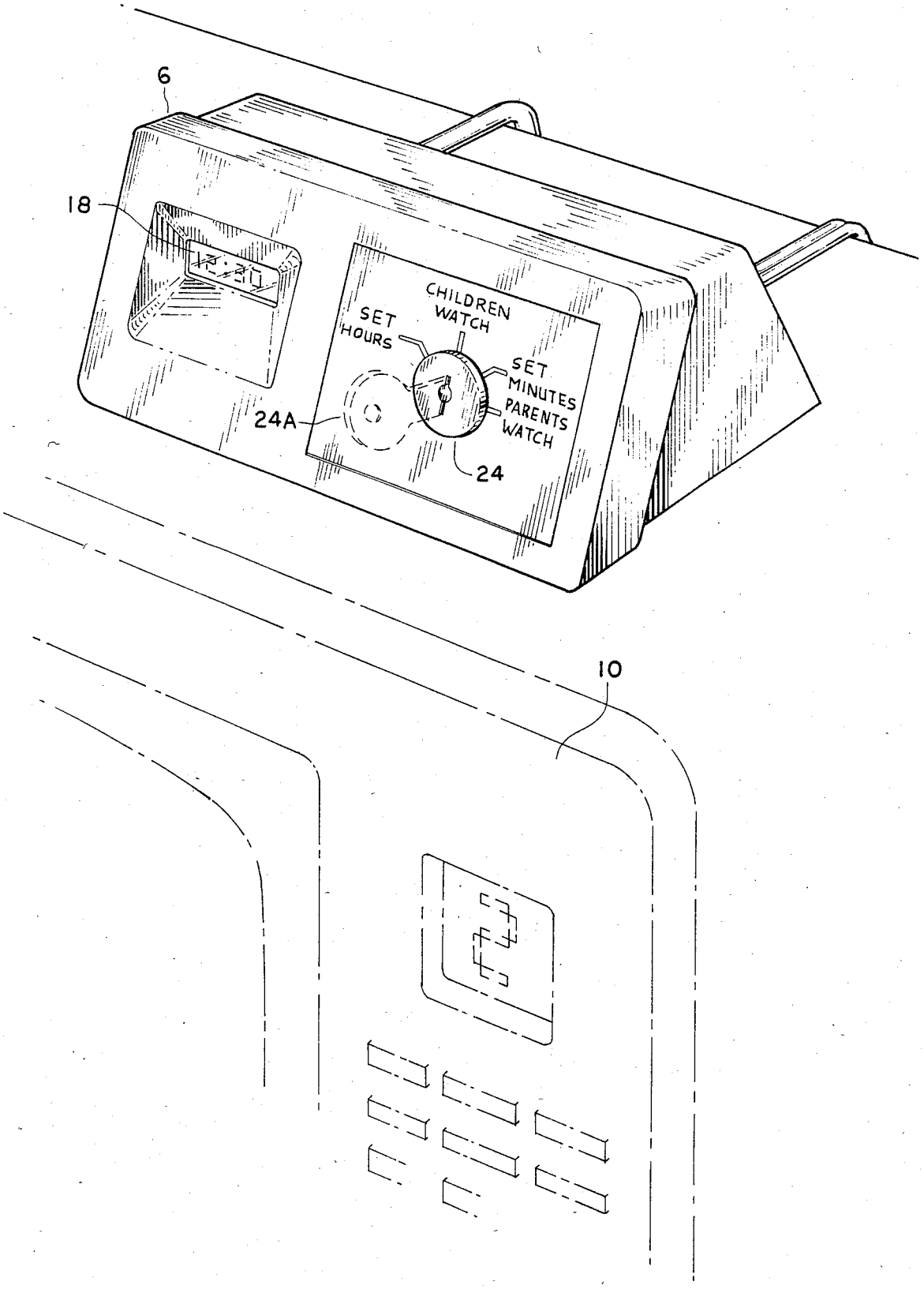
FIG. 1 is a perspective view of a television and a timing device incorporating the present invention.
Figure 2:
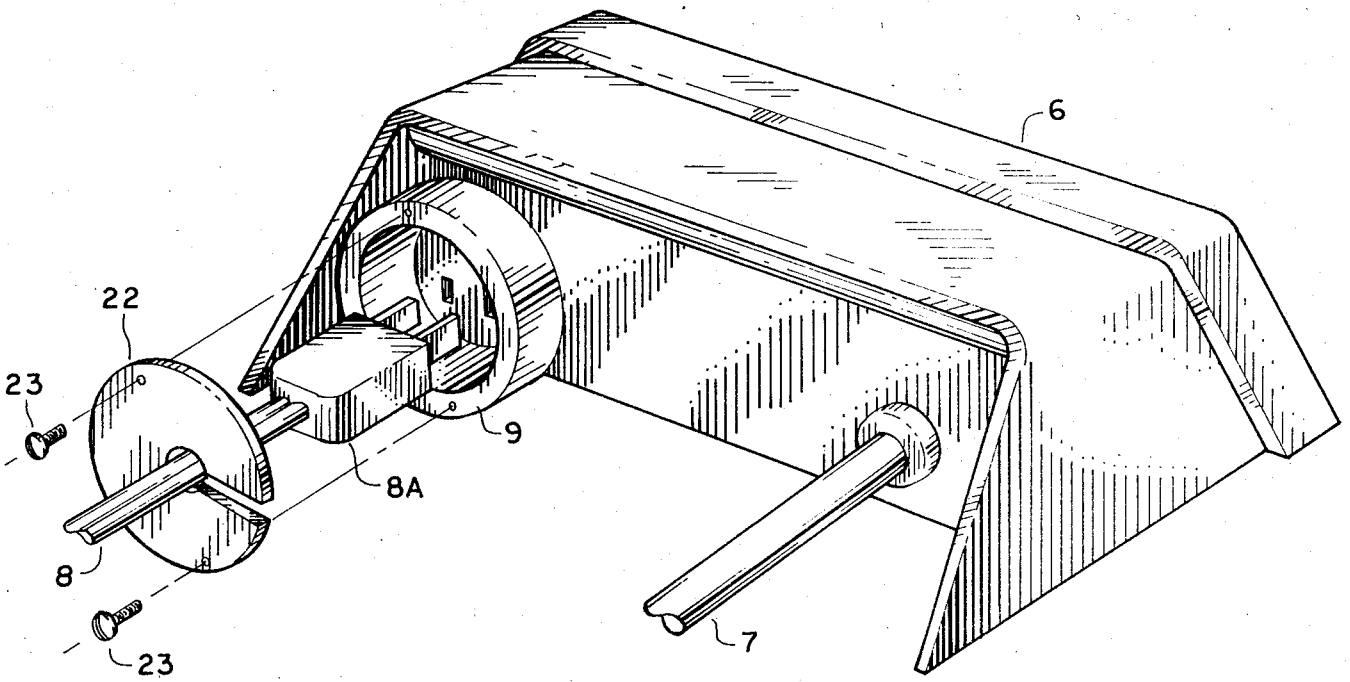
FIG. 2 is a perspective rear view of a timing device incorporating the present invention.

One embodiment of the subject invention is shown in FIGS. 1 and 2 comprising a housing 6 with a liquid crystal display 18 and a key lock switch 24 for control of the device. The overall purpose for this device is to regulate the total time that a television 10 will receive AC power. AC power to the television is through a power cord 8 connecting with an electrical plug 8A to a receptacle 9 as shown in FIG. 2.

The device includes the power cord 7 that can be plugged into a standard AC outlet to receive 110 volt power. The appliance to be regulated, which in this instance is a television set 10, is plugged into the device. Thereafter, a preset time is set on a first counter means

Figure 3:
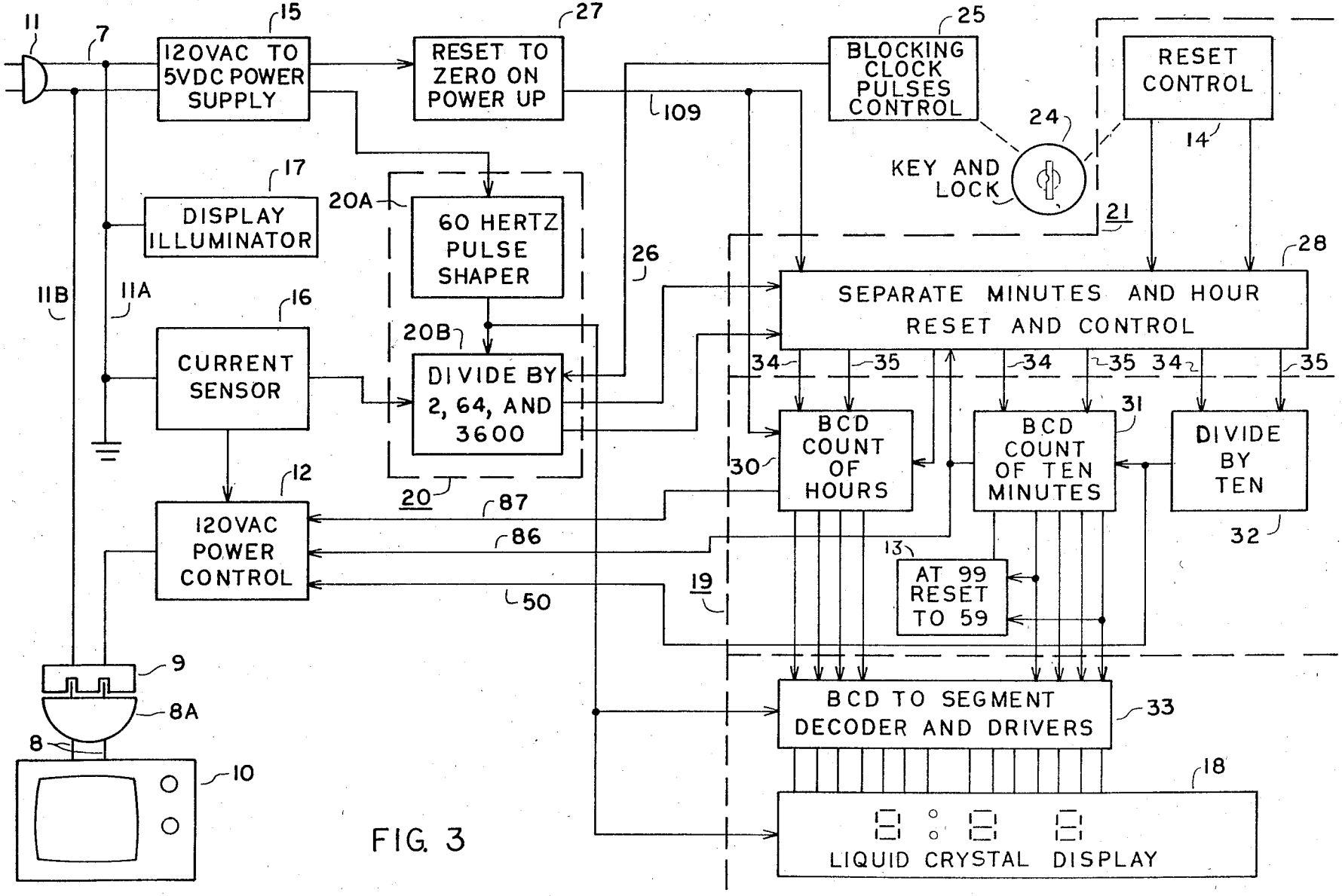
FIG. 3 is an electrical block diagram of one embodiment of the timer.

19 in FIG. 3 and displayed on the liquid crystal display 18. When the television is turned on, a timing pulse generator 20 initiates an action to be explained causing the time period the television is operated to be incrementally deducted from the time setting of the first timer means. When the displayed time 18 reaches zero indicating no preset time is left, the device automatically interrupts the flow of power from the source, thereby shutting off the television. The only way the television can be turned back on is to reset the first timer 19 with additional time, which time period will be indicated on the display.

There are tamper-proof security means provided. To prevent the unauthorized resetting of the time on the first timer, a key lock switch 24 controls all functions of the device. The television cannot be plugged into another outlet to bypass this timer because, as shown in FIG. 2, the electrical plug 8A of the television set is captured. This is insured by the receptacle cover 22 attached to the specially shaped receptacle 9 by two screws 23. Glue applied to the threads of the screws 23 makes the installation of television electrical plug 8A in the timer device permanent. Other tamper-proof security means to prevent unauthorized resetting of the timer without use of the key 24A will be explained later.

Shown in FIG. 3 is an electrical block diagram of one embodiment of the device including the power cord 7 with a plug 11 which fits into a standard convenience outlet (not shown) to supply power both to the control timer device and to the television 10. Additionally, the TV power plug 8A with television power cord 8 is plugged into the receptacle 9 accessible from outside the device housing. The circuit includes a power control switch 12 which is turned on and off by the counter 19. When the AC power control 12 is turned off, no power is supplied to the television through the receptacle 9. The counter 19 is provided power from a power supply 15 which converts 120 volts AC power received through cord 7 to 5 volts DC. A current sensor 16 causes the counter 19 to initiate countdown when it senses that the appliance or television is turned on. Additionally, a display illuminator lamp 17 indicates that AC power is available to the timer. Also the lamp serves to illuminate a liquid crystal display 18 which is visible from outside the device housing. This display shows the overall remaining time that the television can be operated before the device will interrupt power to the television.

Lock switch 24 is operated by a special key 24A to select one of three different functions. In one position of the mechanically operated key bock switch 24, the counter 19 counts down from the preselected time period during the time the television is operated. For this purpose, a pulse shaper 20A of a pulse generator or second counter 20 provides timed pulses. The pulse shaper supplies pulses at 60 hertz to a divider 20B which divides the pulses by 64 and 3600. It is either of these pulses that, when selected, steps down the counter 19. The divide by 64 provides the approximately one second pulses to set the counters, and the divide by 3600 provides one pulse per minute that steps the counters down in real time to limit the appliance operating time. Sixty Hz pulses drive the phase control of the binary coded decimal to the seven segment display decoder 33 and the back plane of the liquid crystal display 18.

In one alternative mode, the key lock switch 24 can be set to block the deduction of operating time, by supplying an inhibit voltage command through the line 26 to the pulse divider 20B. Under these conditions no pulses are provided to the reset control and in this mode the television can be operated without deducting time from the preselected time period. Additionally in a manner to be described later, the key lock switch 24 is utilized for entering the present time into the first counter.

The reset-to-zero control 27 causes the preselected time to be reduced to zero when AC power is restored after the timer has been disconnected from the AC power source. When the loss of AC power is long enough to cause the DC power supply 15 to drop to a voltage level such that a risk exists that the counter 19 will loose its present setting, the reset-to-zero control will drive the counters to zero when power is restored. From the reset-to-zero control the reset pulse is transmitted by conductor 109 to the separate minutes-and-hours control 28 where it is distributed to the proper binary coded decimal digit counter 30,31, and 32.

Figure 4A:
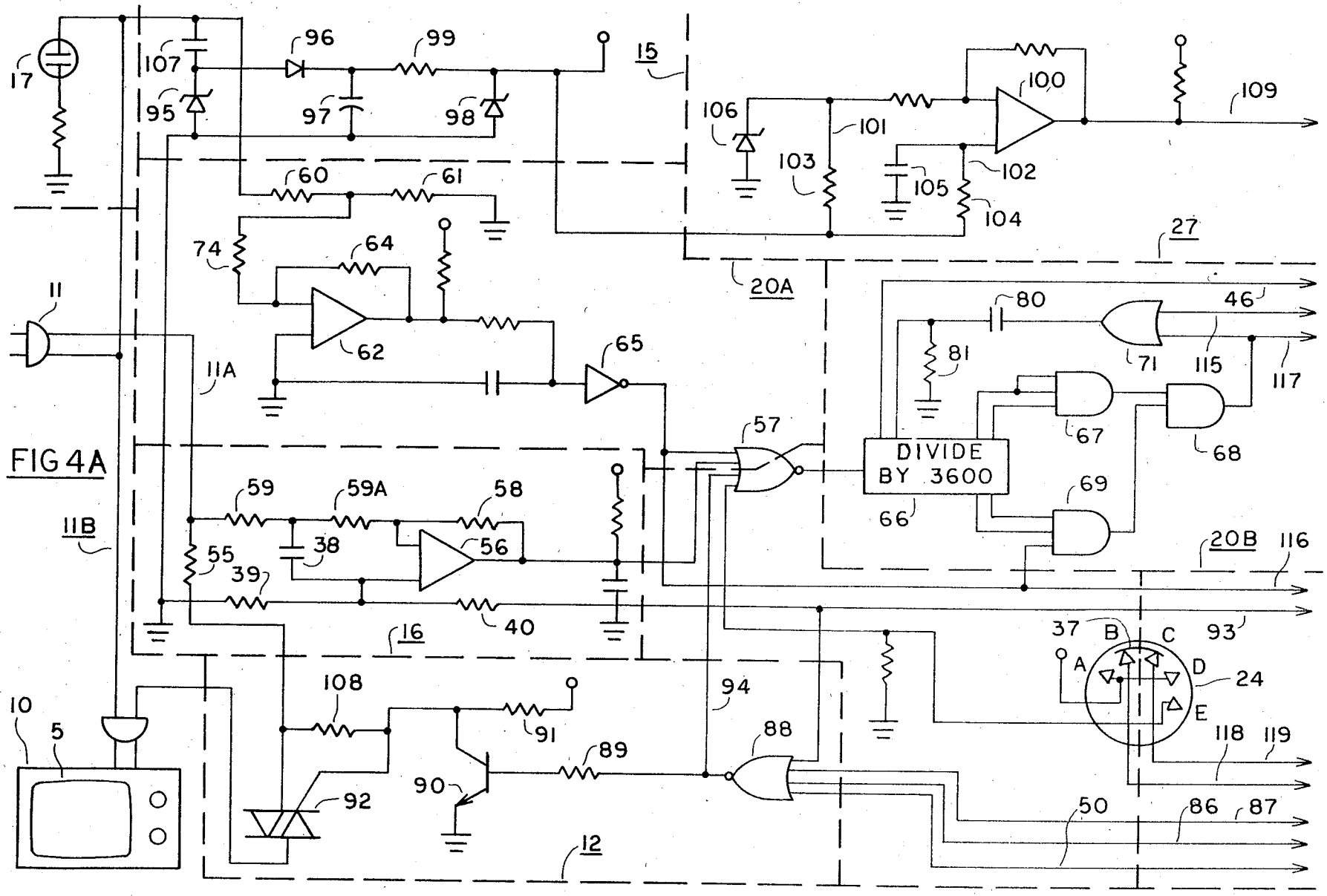
FIGS. 4A and 4B make up an overall schematic of the timer.
Figure 4B:
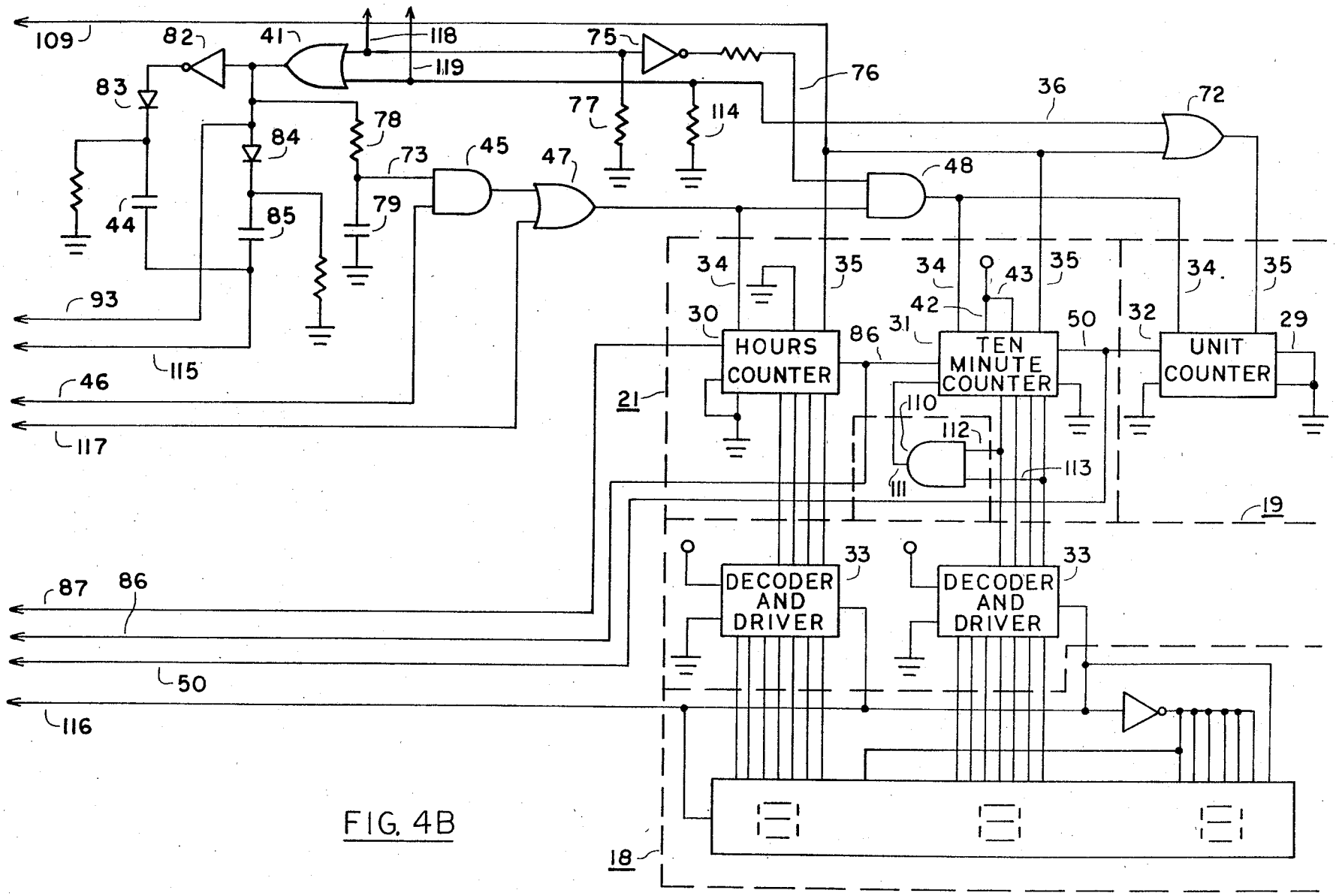

FIGS. 4A and 4B comprise a schematic diagram of the various components shown in block diagram form in FIG. 3, with the comparable blocks being outlined by dotted lines. In this embodiment of the invention all of the logic including gates, counters, and decoders are commercially available integrated circuit CMOS devices.

The current sensor 16 detects the small voltage drop across resistor 55 when current is flowing to the television 10 through a triac 92. The voltage comparator 56 detects the positive half of this small AC voltage across a resistor 55 and produces pulses. A capacitor 38 and resistors 59 and 59A reject high frequency noise carried on the power line. The resistors 39 and 40 form a voltage divider that provides a voltage to insure that the output of the voltage comparator will be zero when the hours or minutes counters are being set, as explained elsewhere. The output of the voltage comparator 56 must be at zero to permit a NOR gate 57 to pass other pulses. A resistor 58 provides feed back or hysteresis from the output to the input of the voltage comparator 56 to prevent oscillation and insure a near square wave output.

The pulse shaper 20A provides pulses for resetting the time on the counters when the television is turned off and no pulses are available from the current sensor. Also a balanced square wave is required to drive the back plane of the liquid crystal display, which is visible whether the television is on or off. Resistors 60 and 61 form a voltage divider across the AC power line with a center tap that supplies a low voltage, further limited by resistor 74, that provides an AC input to the voltage comparator 62. The resistor 64 provides hysteresis that stabilizes the voltage comparator. A Schmitt inverter 65 shapes the output of the voltage comparator 62 into a square wave.

Sixty hertz pulses generated in the pulse shaper 20A and the current sensor 16 can, when required, pass through the NOR gate 57 and cause the ripple counter 66 to count up. The output on the conductor 46 from the ripple counter 66 is the 60 Hz input divided by 64 used to reset the allowed viewing time. The numeric value of the total output of this ripple counter is the sum of the values on the different pins. AND gates 67, 68, and 69 sense four outputs, when all are first present in a count, the outputs total to 3600, or one minute, i.e. 60 cycles times 60 seconds divided by 3600=one minute. A gate 69 cannot generate an output until one half cycle later when all outputs of the ripple counter have settled and the third input goes positive. Outputs from AND gates 67 and 69 result in an output from AND gate 68 which passes through an OR gate 71 and a capacitor 80 to reset the ripple counter 66 to zero. A resistor 81 insures that the ripple counter 66 reset pin will be held at ground except during a reset pulse. Part of that same pulse passes through an OR gate 47 to step the counter 32 down one minute.

To reset the preselected time period, the approximately one second pulses are taken from the timing pulse generator 20. These pulses are the result of dividing the 60 hertz power line rate by 64. These pulses are gated by positioning the key switch 24 either to rapidly step the hours counter 30 or the minutes counters 31 and 32 down. The operator holds the key in position to continue the count down steps until the desired number of hours and minutes are displayed on the liquid crystal display 18. If the count should pass the desired time, it can be continued past zero where it will reset to the maximum and continue to count down as long as the operator holds the key in position.

To set the hours on the first timer, the key is turned to bridge the contacts A and B. With the key switch 24 set to the hours position, i.e. the bridge 34 contacts A and B to provide a voltage to the OR gate 41 which turns on AND gate 45 so the one second pulses can pass to the OR gate 47 and into the hour counter 30. The same contacts A and B on the key switch 24 cause an inverter 75 to switch the conductor 76 to ground level and thus prevent any pulses passing through the AND gate 48 to step either the minutes counter 32 or the tens of minutes counter 31. Thus the hours counter can be set separately.

Because the conductor 29 is tied to ground the counter 32 always counts down on every pulse received. With the key switch set to the minute position, i.e. the bridge 37 touches the contacts C and D, both the AND gates 45 and 48 are enabled to pass pulses. AND gate 48 is enabled because the conductor 76 is high with the input to the inverter 75 being held low through the resistor 77. AND gate 45 is again enabled to pass the one second pulses in the conductor 46 because the conductor 73 is held high by the voltage passing through the OR gate 41. Thus the pulses pass through the gates and appear on the conductors 34 to step the minute counters 31 and 32, but not the hour counter 30.

The minutes time can only be adjusted in ten minute increments. When the key switch is positioned to reset minutes, the voltage on the conductor 36, passing through OR gate 72 to conductor 35, resets invisible minute units on the counter 32 to zero. This insures that the time stored in the minute counter will be as indicated on the display 18 where the unit minute numeral is always displayed as a zero. Although the digit is not displayed on the liquid crystal display, the counter 32 is stepped down by pulses through the conductor 34. The ten minute character display changes at the next pulse after the unit minutes counter 32 reaches zero. The zero count causes the conductor 50 to drop to ground level. This allows the ten minute counter to count down one digit on the next pulse on the conductor line 34. That same pulse on the conductor 34 causes the unit minute counter to step down one digit to 9 and the conductor 50 to return to its high level to thus again inhibit the ten minute counter.

When any of the three counters 30, 31, 32 reach zero their borrow lines 87, 86, or 50 respectively drop to ground potential. In the case of counters 31 and 32 this causes the next higher order counter to also accept the next count pulse.

The commercially available binary coded decimal counters, such as counters 31 and 32, count to 99 and reset to zero. However, this device must reset to zero on the next count after 59 and not 95. Thus when the counter 30 switches to nine minutes the AND gate 110 senses high inputs due to a "one" and an "eight" on conductors 112 and 113 and this results in the ouput 111 going high which commands a reset of the counter 31. The reset inputs on conductors 42 and 43 have values of 4 and 1 respectively, or a total of 5 when held high. Thus when the reset signal appears on the conductor 111, the counter output switches in less that a microsecond to 5 and the conductor 111 returns to ground potential.

The square wave pulses on the conductor 46 are high one-half of the time, and this voltage could act to pass false key lock switching pulses through AND gates 45 and 48 to counters 30, 31 and 32. A feature of this invention prevents such spurious pulses generated by the lock switch from entering the counters. The voltage passing either from contact D through the bridge 37 to contact C or from contact A to contact B and on through OR gate 41 is delayed in its effect on AND gate 45 by passing through the resistor 78 and being collected in the capacitor 79 until after the pulse out of the OR gate 41 has passed through the OR gate 71 to reset counter 66 to zero. This insures that the conductor 46 will remain at ground for one-half second. The capacitor 80 and the resistor 81 limit the reset pulse "on" time at the counter 66.

Mechanical contact bounce on contact "make" can cause extra counts in high speed logic systems such as used here, unless they are prevented from reaching the counters. This can occur where a leading edge of the first detected pulse is a voltage rise. The AND gate 45 is prevented from passing any first pulses, for a short period, after the key switch 24 is set to either the minutes or hours reset, because input conductor 73 remains low, as explained above. Because counter 66 has been reset to zero, there will be an additional one half second before input conductor 46 will rise with the leading edge of the first pulse from counter 66. This combination of delays prevents any "make" contact bounce generated pulses until the contacts have had time to stop bouncing.

Contact bounce counts on contact break are also prevented by resetting counter 66 to zero at the first detected change. In this case the leading edge of the first detected pulse will be a drop to ground level. Before the trailing edge of such a spurious pulse can rise again the AND gate 45 must be disabled to prevent passage. This is accomplished by resetting the counter 66 to zero. Every contact noise pulse from contacts B or C of key switch 24, whether a "make" contact or a "break" contact, will pass through the OR gate 41, and the leading edge of the pulse will result in a pulse that will then pass through the diode 84 and capacitor 85. In either case the result is a positive pulse that resets the counter 66. The diodes 83 and 84 insure that the first leading edge passing through will only be a positive swing, to reset the counter 66.

The control of power to the TV set is regulated by the triac 92. Conductors 86 and 87 function in the same manner as the conductor 50. Thus when counter 31 drops to zero, conductor 86 drops to ground level, and conductor 87 goes to ground level when the hours counter 30 contains a zero. When conductors 50, 86, and 87 are all at ground, this indicates that the counter 19 has reached zero on all digits. When the television operation time is being counted down conductor 93 is held at ground by resistors 77 and 114 on the inupts to OR gate 41. Thus the four input NOR gate 88 with all low inputs will change to a high output and the resulting current through resistor 89 drives transistor 90 into saturated conduction. The current flowing through the current limiting resistor 91 is bled directly to ground removing the drive current from the control gate of triac 92. This forces the triac 92 to switch off and the television set thus is denied power.

With a high output on NOR gate 88, the conductor 94 provides a high input to the NOR gate 57 which locks the timer in the "off" condition because no pulses can pass through NOR gate 57 to any part of the counter logic. This electrical lock is important because it prevents the resetting of time on the counters by high amplitude electrical noise, such as switching transients on the AC power line or deliberately generated local electrical noise intended to reset the timer without the key. Otherwise after 3600 such false pulses, the timer would reset and the television could be operated. The requirement that 3600 false pulses would be required provides additional security.

As just described, when the key switch 24 is turned to either set hours or minutes, OR gate 41 will energize the conductor 93 and this will cause the output of the NOR gate 88 to drop to ground level and thus the triac 92 gate will be energized and power can again flow to the TV set 10. If the television set switch is set to "on", the current sensor will detect that the television is drawing current and will supply input pulses. If the television set is switched off, the timer counters can only be reset by pulses from the pulse shaper 20A which is provided for this purpose.

The power supply 15 that converts the 120 volt AC power to about 5 volts filtered DC drives all elements of the timer. This low voltage power supply must have a common ground with one side of the AC power line. It is most important that the common ground be at exactly the same potential as the side of the power line that passes through the triac 92, or it could not turn the triac fully "on" and "off".

This invention uses a capacitor 107 to limit the AC current flow and voltage to the DC voltage power supply. Very, very little heat is generated. On one half cycle of the 60 Hz power line the capacitor 107 takes a positive charge on the bottom plate. On the next half cycle of the power line this charge cannot escape back through diode 95 but is forced out through diode 96 to charge the capacitor 97. With the capacitor values used, if no power were consumed in the logic, about 20 cycles of the AC line are required to fully charge the DC power supply storage capacitor 97 before any current will be bled off through the zener diode 98, which limits the DC voltage. The actual time for the voltage to rise is increased by the drain of the circuits. This slow rise of the power supply to full operating voltage gives an additional margin to the operation of the reset-to-zero control that will be explained later. Thus a small charge is pulled in during a half cycle and forced into the storage capacitor 97 in the following half cycle. The resistor 99 provides filtering of the current flow to the timer.

The conservation of energy in this invention is indicated by the fact that on the second half cycle the packet of electrons on the bottom of capacitor 107 is pushed through the diode 96 to a potential of only 5 volts above timer ground. This means that the electrons have gone through a cycle that has only changed their potential from ground by 5 volts total. Note that, other than the unbalanced 5 volt shift, the charge on the capacitor 107 alternates with the AC power line and conserves the energy stored on each half cycle except for a small dielectric loss. This means that most of the energy stored in the capacitor is returned to the AC power line on the next half cycle. Thus no detectable heat is generated.

Circumvention of the time limitation of the timer might be attempted by disconnecting the timer from the wall receptacle and plugging it back into the receptacle. This action will instantly eliminate the remaining viewing time and thereby prevent future tampering with the timer. The objective is only to reset the timer to zero when, due to low DC supply voltage, the timer would not be able to retain the correct remaining time.

The reset to zero control 27 senses through a voltage comparator 100 the difference in the rate at which conductors 101 and 102 rise in voltage when the power supply 15 is again fully energized after dropping to a low voltage level. The conductor 101 tracks exactly through resistor 103 any increasing voltage level of the power supply 15 until the breakdown level of zener diode 106 is reached. The resistor 103 limits the energy lost through the zener diode 106 during steady state operation. The breakdown voltage of the zener diode 106 is selected to be a minimum safe value above the minimum voltage at which the counters in this timer can reliably retain their true count. Any time that the DC power supply voltage drops below the minimum break down voltage of zener diode 106 the reset-to-zero control is set to function. As the power supply voltage rises after such a power input loss, current flows through the resistor 104 to charge the capacitor 105 which delays the rise to the voltage on the conductor 102 and causes it to lag behind both the power supply 15 rate of voltage increase and the voltage on the conductor 101. This results in a voltage output from the voltage comparator 100, which voltage will reset the counters 30, 31, and 32 to zero. As long as the power supply voltage is higher than the breakdown of the zener diode 106, the conductor 101 will remain at a lower voltage than the conductor 102, and there will be no output from the voltage comparator 100.

It is well known that power companies do not provide well controlled AC power. Switching transients and low voltage conditions, which are called brownouts, are not uncommon on power lines. Therefore this timer will not reset the time to zero during short switching transients, or expected low voltage conditions on the power line for the following reasons: The capacitor 97 stores enough energy to operate the timer for more than a second, thus power company switching transients very rarely will be long enough to cause the timer to reset to zero. Because more current is supplied to the storage capacitor 97 than is required, even at less than 60% of the usual 10 volts on the power line it is the nature of this power supply 15 to maintain the voltage level fixed by zener diode 98. Thus the timer will only be reset if its plug is removed from the wall, or if a power failure exists for a noticeable period of time.

The invention claimed is:

1. A device for measuring and regulating the time an electrical appliance receiving power through a first power cord having a first plug thereon is used, comprising:

a first counter including means to set a time period on said first counter indicating the total time the electrical appliance can be used;

means to sense the flow of electrical current in the first power cord of the electrical appliance;

a second counter operable in response to the sensing means indicating said electrical appliance is receiving a flow of electrical current to deduct the time the appliance receives current from said time period of the first counter;

an indicator visually indicating the time period on said first counter; and means operable to prevent said second counter from deducting time from said first counter time duration.

2. A device as defined in claim 1 including a case enclosing said device, said case including an electrical outlet for receiving and transmitting electric current to the first plug of said appliance.

3. A device as defined in claim 2 including means to automatically reset said first counter time period to zero if said first plug is removed from said electrical outlet.

4. A device as defined in claim 3 including means to retain said first plug in said electrical outlet.

5. A device as defined in claim 2 wherein said means to set said first counter time period and means to prevent said second counter from deducting time from said first counter is incorporated in a multiposition switch.

6. A device as defined in claim 5 wherein said switch is key operated.

7. A device as defined in claim 2 including a second power cord having a second plug for supplying electrical power to the device by plugging said second plug into a power outlet, and means to automatically reset said first counter to zero if said second plug is removed from said power outlet.

8. A device as defined in claim 7 including means to derive power through said second plug for supplying electrical power to operate said first and second counters.

9. A device as defined in claim 8 wherein said means to derive power through said second plug comprises a first capacitor and diode connected to receive electric current through said second plug, and means to derive electric current from said first capacitor to operate said first and second counters.

* * * * *